US008191524B2

(12) United States Patent
Elendt et al.

(10) Patent No.: US 8,191,524 B2
(45) Date of Patent: Jun. 5, 2012

(54) VALVE-TRAIN ASSEMBLY OF AN INTERNAL COMBUSTION ENGINE

(75) Inventors: Harald Elendt, Altendorf (DE); Andreas Nendel, Hessdorf (DE); Mathias Boegershausen, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 303 days.

(21) Appl. No.: 12/704,759

(22) Filed: Feb. 12, 2010

(65) Prior Publication Data

US 2010/0224154 A1 Sep. 9, 2010

Related U.S. Application Data

(60) Provisional application No. 61/158,003, filed on Mar. 6, 2009.

(51) Int. Cl.
*F01L 1/04* (2006.01)

(52) U.S. Cl. ..... 123/90.6; 123/90.16; 123/90.31

(58) Field of Classification Search ..... 123/90.16, 123/90.2, 90.27, 90.31, 90.6
See application file for complete search history.

(56) References Cited

U.S. PATENT DOCUMENTS 7,472,671 B2 * 1/2009 Elendt et al. ..... 123/90.6

FOREIGN PATENT DOCUMENTS

DE 10148177 4/2003

* cited by examiner

*Primary Examiner* — Ching Chang
(74) *Attorney, Agent, or Firm* — Volpe and Koenig, P.C.

(57) ABSTRACT

A valve-train assembly of an internal combustion engine is provided with a camshaft (1) that includes a carrier shaft (2), as well as a cam element (3) that can move on the carrier shaft between two axial positions and that has at least one cam group of directly adjacent cams (5, 6) with different cam lobes and an axial connecting link (8) constructed with a groove with outer guide walls (12, 13, 14, 15) for defining two intersecting connecting link pathways (9, 10), and with an activation pin (11) that can couple in the axial connecting link for moving the cam element in the direction of both connecting link pathways. In this way, the groove base of one connecting link pathway and the groove base of the other connecting link pathway should extend radially offset in height relative to each other, so that the connecting link pathway (9) with the radially lower groove base is also defined by inner guide walls (19, 20) that are formed by the offset in height.

11 Claims, 2 Drawing Sheets

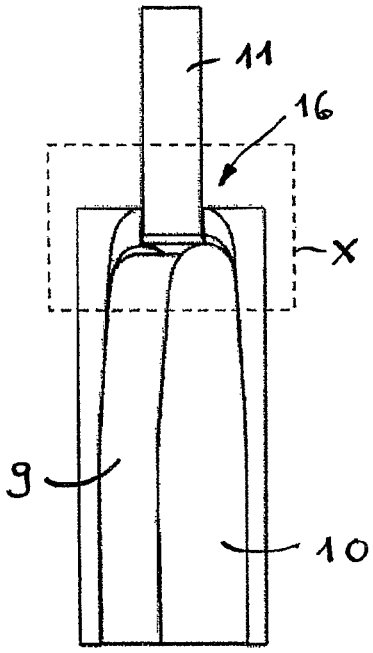
Fig. 5
Fig. 6
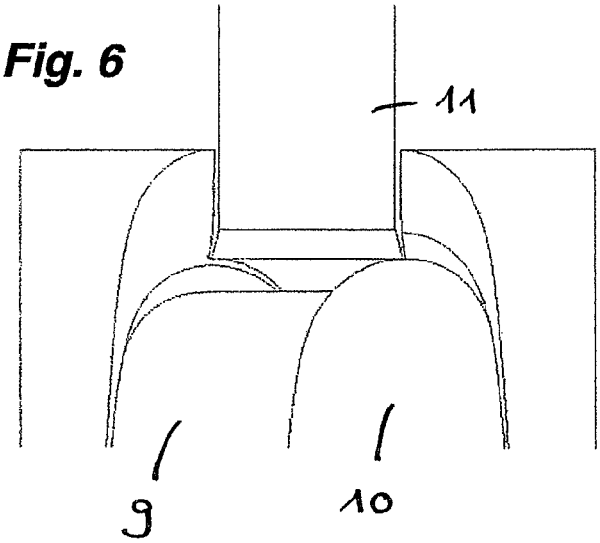
Fig. 7
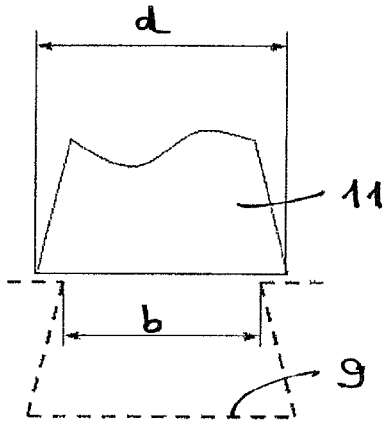
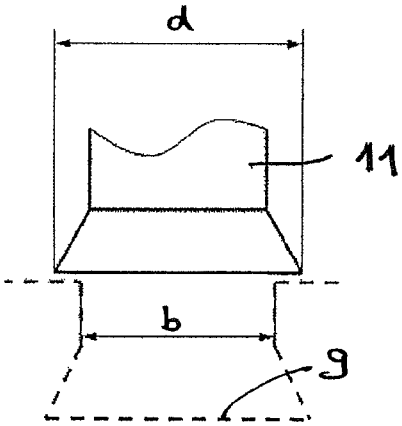
Fig. 8
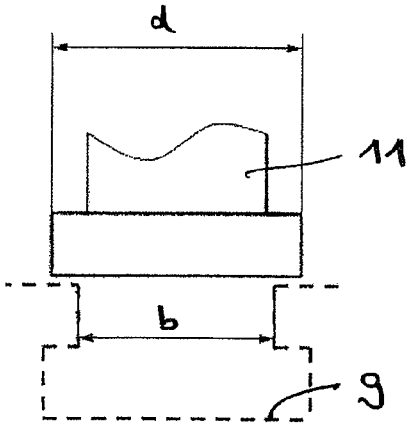
Fig. 9

VALVE-TRAIN ASSEMBLY OF AN INTERNAL COMBUSTION ENGINE

CROSS-REFERENCE TO RELATED APPLICATIONS

This application claims the benefit of U.S. Provisional Application No. 61/158,003, filed Mar. 6, 2009

BACKGROUND

The invention relates to a valve-train of an internal combustion engine with a camshaft that comprises a carrier shaft as well as a cam element that is locked in rotation on this carrier shaft and that can move between two axial positions and that has at least one cam group of directly adjacent cams with different cam lobes and an axial connecting link constructed as a groove with external guide walls for defining two intersecting connecting link pathways, and with an activation pin that can couple into the axial connecting link for moving the cam element in the direction of both connecting link pathways.

Such a valve-train assembly that is used for the variable activation of gas-exchange valves by moveable cam elements and in which a single activation pin is sufficient for each cam element, in order to move the cam element in the direction of both connecting link pathways, is already known from DE 101 48 177 A1, which is considered class-forming. In that publication, two cam elements are disclosed with alternatively constructed axial connecting links, wherein the first axial connecting link has a central guide web for forming inner guide walls for the activation pin and the second axial connecting link consists merely of outer guide walls.

The latter construction has the advantage that the production expense for the axial connecting link is significantly lower due to the elimination of the guide web. One significant risk with respect to the functional safety of the valve-train assembly in the case of this construction is that, however, the displacement process of the cam element is completely finished, i.e., without incorrect switching, only when the inertia of the mass in motion of the cam element is sufficient to move it into its other end position after passing through the intersection region of the connecting link pathways without forced guidance of the activation pin, that is, to a certain extent, in free fall. A prerequisite for the sufficient inertia of the mass in motion of the cam element is obviously a minimum rotational speed of the camshaft that is directly dependent on the friction between the cam element and the carrier shaft. Displacement of a cam element with a rotational speed below this minimum rotational speed could have the result that the cam element remains "at a half-way point" and a cam follower acting on the gas-exchange valve is simultaneously acted upon by several cams of the cam group in an uncontrolled manner and simultaneously under high mechanical loading. In addition, in this case there is no longer the ability to move the cam element through action of the activation pin later into one of the end positions, because in this case there is no longer axial allocation between the activation pin and the outer guide walls.

This functional risk is indeed significantly smaller in the case of the first construction of the axial connecting link with a central guide web whose inner guide walls cause a further accelerating forced guidance if the rotational speed of the cam element is lower than the activation pin. Nevertheless, there is also the risk here that the activation pin does not pathway into the specified connecting link pathway after passing through the intersection region, but instead collides with the end face of the guide web also under high mechanical loading.

SUMMARY

The present invention is therefore based on the objective of improving a valve-train of the type noted above so that the mentioned functional limitations and risks are at least partially eliminated. In particular, the objective is to guarantee a successful, i.e., complete changeover process of the cam element at least in the direction of one axial position also in the case of a low rotational speed of the camshaft, for example, during the startup process of the internal combustion engine.

The solution of achieving this objective is provided in that a groove base of one of the connecting link pathways and a groove base of the other of the connecting link pathways are offset in height radially relative to each other, so that the connecting link pathway with the radially lower groove base is also defined by inner guide walls that are formed by the offset in height. Consequently, the connecting link pathway with the radially lower groove base is defined both by the outer guide walls and also by the inner guide walls formed by the height offset, so that a forced guidance of the activation pin in this connecting link pathway is set and consequently a displacement process of the cam element into the associated axial position independent of the rotational speed of the camshaft is made possible. Further advantages, refinements and constructions of the invention are described below and in the claims.

The functional limitations noted above are indeed only partially eliminated to the extent that the forced guidance of the activation pin is effectively only in the direction of one axial position and a successful displacement process of the cam element in the other direction is still dependent on the force of inertia of the cam element and consequently on the corresponding minimum rotational speed of the camshaft. Based on the present invention, this remaining disadvantage can be nevertheless considerably minimized in that the changeover process of the camshaft follows a so-called switching hysteresis. Under this term, it is to be understood that the back and forth motion of the cam element on the carrier shaft is performed only when the rotational speed exceeds or falls below specified threshold rotational speed values. For example, it could be provided that the displacement of the cam element takes place from a small to a large effective cam lobe along the connecting link pathway with the radially higher groove base and at a first threshold rotational speed above the mentioned minimum rotational speed. This is because, at this rotational speed, due to the sufficient inertia of the mass in motion of the cam element, complete forced guidance of the activation pin in the connecting link pathway is not required. On the other hand, the return of the cam element from the large to the small effective cam lobe takes place at a second threshold rotational speed that is significantly below the mentioned minimum rotational speed, because the activation pin now must move under forced guidance along the connecting link pathway with the radially lower groove base.

For the purpose of simpler wording, in the following the connecting link pathway with the radially lower groove base is designated as the low connecting link pathway and the connecting link pathway with the radially higher groove base is designated as the high connecting link pathway.

In one refinement of the invention it is provided that the height offset extends across almost the entire peripheral region of the connecting link pathways. Apart from radially increasing outlet regions of the connecting link pathways that push the activation pin out from the axial connecting link into its non-engaged rest position and that run, in some sections, at the same radius, i.e., without a height offset, this construction creates an essentially uniform pathway profile for each groove base with respect to radial run-outs on the activation pin.

In addition, with respect to the rotational direction of the camshaft, the height offset should be larger immediately in front of the intersection region of the connecting link pathways than immediately after this region. With this option it can be prevented that the activation pin moving along the high connecting link pathway into the low connecting link pathway when passing through the intersection region and collides with its axially opposite inner guide wall under high mechanical loading.

However, such a collision could then be ruled out with greatest security if the low connecting link pathway has, at least in the intersection region of the connecting link pathways, an undercut profile with an open width that is smaller than the diameter of the connecting link-side end face of the activation pin. Here, both connecting link pathways advantageously have an undercut profile. Through the positive-fit connection generated in this way between the activation pin and the connecting link pathways, not only tracking of the activation pin in the low connecting link pathway, but also a premature ejection of the activation pin from the axial connecting link is prevented due to "bumps" on the groove base caused by tolerances or wear.

The undercut profile advantageously has a dovetail-shaped or T-shaped construction. With respect to the lowest possible contact pressures, the connecting link-side end section of the activation pin and the undercut-shaped profile should also be constructed essentially complementary to each other.

A catch device for fixing the cam element in the axial position should have at least one catch body supported so that it can move in a radial borehole of the carrier shaft and catch grooves that run on the inner periphery of the cam element axially adjacent on both sides of a peak and in which the catch body is engaged in the axial positions. Here, the catch body forced by a spring element in the radially outward direction should be loaded with an axial force by catch groove walls of the catch grooves starting from the peak, wherein this axial force is directed toward the respective, associated axial position. The peak should run, with respect to the spacing of the axial positions, eccentrically on the side of the axial position in which the cam element is shifted along the low connecting link pathway.

As will also become clear in an embodiment of the invention explained later, this construction causes a force to be applied on the cam element that exceeds inertial forces already before passing through the intersection region when this is pushed along the high connecting link pathway, i.e., without the forced guidance of the guidance walls. The displacement force exerted by the catch device consequently allows a lowering of the mentioned minimum rotational speed and/or an increase of the security against incorrect changeover of the cam element.

Advantageously, two diametrically opposing catch bodies are provided in the radial borehole of the carrier shaft formed as a passage borehole.

With respect to a cost-effective construction of the catch device, the spring element should involve a spiral compression spring and the catch body should involve a one-sided, open sheet-metal formed part whose open side is constructed as a hollow cylinder supported in the radial borehole and enclosing the spiral compression spring and whose closed side is constructed as a conical and/or spherical hollow body tapering in the direction of the catch grooves. In order to guarantee the lowest possible resistance for the inlet and outlet of the catch body into and out of the radial borehole during the movement of the cam element, the catch body could be provided with a pressure release opening in the region of the hollow body.

As far as is possible and useful, the previously mentioned features and constructions of the invention should also be able to be combined with each other arbitrarily.

BRIEF DESCRIPTION OF THE DRAWINGS

Additional features of the invention are given from the following description and from the drawings in which one embodiment of the invention is shown. Unless otherwise indicated, identical or functionally identical features or components are provided with identical reference symbols. Shown are:

FIG. 5 shows an axial connecting link with dovetail-shaped connecting link pathways, FIG. 6 shows the detail X according to FIG. 5 in an enlarged view, and FIGS. 7-9 show variants of connecting link pathways with an undercut-shaped profile, and complementary activation pins in schematic diagram.

DETAILED DESCRIPTION OF THE PREFERRED EMBODIMENTS

Figure 1:
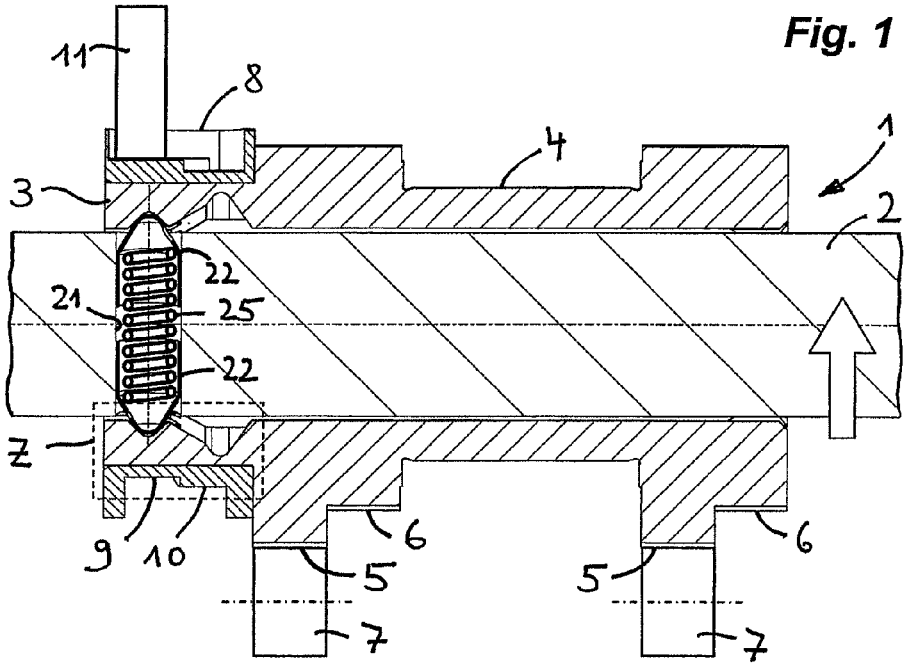
FIG. 1 shows a cutout of a valve-train according to the invention in longitudinal section.

In FIG. 1, a cutout of a variable valve-train assembly of an internal combustion engine that is essential for the understanding of the invention is disclosed. The valve-train assembly has a camshaft 1 that comprises a carrier shaft 2, as well as cam elements 3 that are locked in rotation—corresponding to the cylinder number of the internal combustion engine—and that are arranged so that they can move between two axial positions. For the purpose of axial displacement, the carrier shaft 2 is provided with external longitudinal teeth and the cam element 3 is provided with corresponding internal longitudinal teeth. The teeth are known and not shown in more detail here.

The cam element 3 has cam groups arranged on both sides of a bearing point 4 each with two directly adjacent cams 5 and 6 that have different cam lobes for an identical base circle radius. The displacement of the cam element is performed outside of the cam lobes during the common base circle phase of the cams 5, 6. The cam lobes are each transferred selectively in a known way from a cam follower symbolized here only by a cam roller 7, such as, e.g., a rocker arm, to a not-shown gas-exchange valve as a function of the instantaneous axial position of the cam element 3. Under the different cam lobes, different magnitudes of the respective cam element stroke and/or different valve control times of the cams 5, 6 are to be understood.

Figure 3:
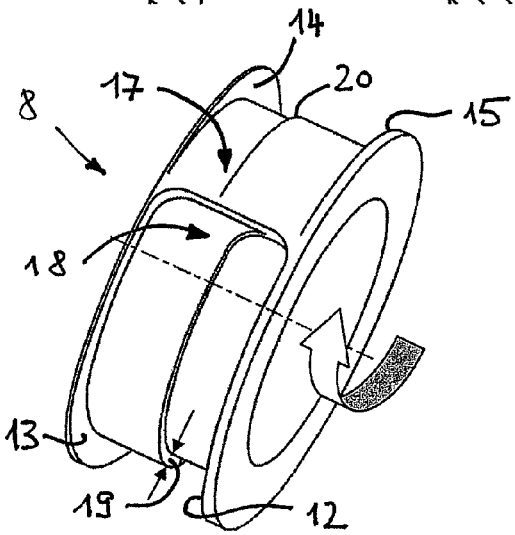
FIG. 3 shows an axial connecting link according to FIG. 1 in a first perspective view.
Figure 4:
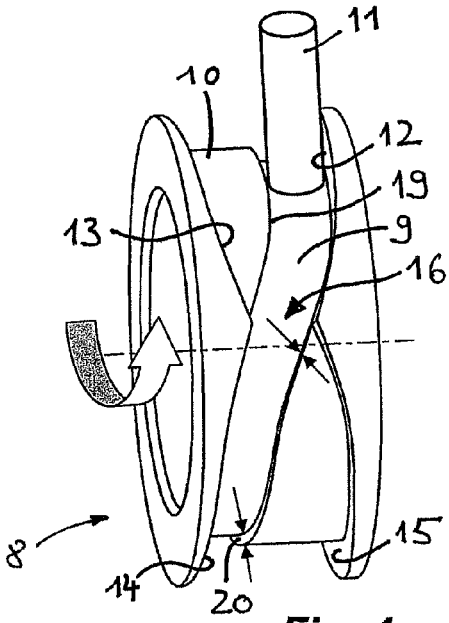
FIG. 4 shows the axial connecting link in a second perspective view.

For switching between the cams 5 and 6 and, as shown, from the instantaneously effective cams 5 to the cams 6, the cam element 3 with an axial connecting link 8 is provided with two intersecting connecting link pathways 9, 10. The axial connecting link 8 that is produced as a single part and that is joined by an interference fit assembly and that is shown in more detail in FIGS. 3 and 4 from different perspectives is constructed with a groove and interacts with an activation pin 11 that extends radially relative to the camshaft 1 and that is arranged axially fixed in place with respect to the camshaft 1, but radially displaceable in the internal combustion engine, and is used together with the axial connecting link 8 for displacing the cam element 3 in the direction of both connecting link pathways 9, 10. The activation pin 11 is part of a similarly known actuator for such valve-train assemblies and is not explained in greater detail at this point.

The connecting link pathways 9, 10 are defined by axially acting outer guide walls 12, 13, 14, 15 of the axial connecting link 8, wherein the cam element 3 rotating in the illustrated direction of rotation is first supported with the accelerating guide walls 12 and 13 and then, after the intersection region 16 of the connecting link pathways 9, 10, with the decelerating guide walls 14 and 15 on the activation pin 11. As already mentioned, this change in contact assumes a sufficient axial inertia of the mass in motion of the cam element 3 and consequently a corresponding minimum rotational speed of the camshaft 1. The activation pin 11 is engaged with the connecting link 8 only during the displacement process of the cam element 3 and is moved back into its disengaged rest position at the end of the displacement process by the connecting link pathways 9, 10 rising radially in its outlet region 17. As can be seen from FIG. 3, an inlet region 18 with constant radial height is directly adjacent to the appropriate outlet region 17, wherein the activation pin 11 enters this inlet region for renewed displacement of the cam element 3 in the axial connecting link 8.

The groove base of the connecting link pathway 9 and the groove base of the connecting link pathway 10 run with a height offset relative to each other across the entire peripheral region of the connecting link pathways 9, 10, so that the low connecting link pathway 9 is also defined by inner guide walls 19, 20 that are formed by the height offset. The resulting forced guidance for the activation pin 11 also then allows a complete displacement process of the cam element 3 along the connecting link pathway 9, when the rotational speed falls below the mentioned minimum rotational speed of the camshaft 1 and due to insufficient inertia of the mass in motion, the cam element 3 is no longer supported with the decelerating outer guide wall 14, but instead now with the inner guide wall 20 on the activation pin 11, immediately after passing through the intersection region 16.

In order to securely prevent the activation pin 11 traveling on the high connecting link pathway 10 from tracking into the low connecting link pathway 9, the height offset—with respect to the rotational direction of the camshaft 1—is greater immediately before the intersection region 16 than immediately after. This is symbolized by the dimensions drawn in FIGS. 3 and 4, wherein, in the illustrated embodiment, a height offset of approximately 0.2 mm is provided immediately after the intersection region 16 and otherwise a height offset of approximately 1 mm is provided, as shown here as an example using two different peripheral sections.

Indeed, the tracking of the activation pin 11 into the low connecting link pathway 9 is considered unlikely with respect to its own inertia of the mass in motion and the extremely small time interval in which the activation pin 11 and the low connecting link pathway 9 completely overlap. Nevertheless, FIGS. 5 to 9 show additional structural options with which, when the intersection region 16 is being passed, tracking of the activation pin 11 in the low connecting link pathway 9 can be ruled out with even greater security. As can be seen in FIG. 5 and in FIG. 6 with the enlarged detail X, both connecting link pathways 9, 10 are provided in the intersection region 16 with an undercut profile, here in the form of a dovetail. The connecting link-side end section of the activation pin 11 is constructed complementary to this and has—as shown in FIG. 7—on the end face a diameter d that is greater than the open width b of the low connecting link pathway 9. Due to this positive-fit connection, undesired tracking of the activation pin 11 in the low connecting link pathway 9 is not possible even at very low rotational speeds of the camshaft 1.

Geometrically alternative undercut-shaped profiles and complementary activation pins 11 could also have dovetail shapes with additional parallel profile portions according to FIG. 8 or T-shaped according to FIG. 9.

For the case that one or both connecting link pathways 9, 10 are provided with an undercut-shaped profile, obviously undercut-free inlet and outlet regions 18, 17 are to be provided, in order to allow the inlet and outlet of the activation pin 11 into and out from the respective connecting link pathway 9 or 10.

Figure 2:
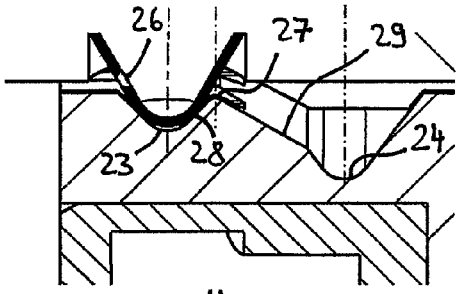
FIG. 2 shows the detail Z according to FIG. 1 in an enlarged view.

In order to fix the cam element 3 in its axial position relative to the carrier shaft 2, a catch device shown in FIG. 1 and as an enlarged detail Z in FIG. 2 is provided. This comprises two diametrically opposed catch bodies 22 supported so that they can move in a radial borehole 21 of the carrier shaft 2 formed as a passage borehole and catch grooves 23 and 24 that run on the inner periphery of the cam element 3 and that are constructed as peripheral grooves and in which the catch bodies 22 forced by spring means 25 in the radially outward direction are engaged in the respective, associated axial positions.

The catch bodies 22 involve thin-walled sheet-metal shaped parts that are open on one side. Their open side is each formed as a hollow cylinder supported in the radial borehole 21 and enclosing the spring element 25 formed as a spiral compression spring, while the closed side adjacent to it involves a hollow body that tapers in the direction of the catch grooves 23, 24 and that is initially conical and spherical on the end. In order to guarantee a low-resistance inlet of the catch bodies 22 into the radial borehole 21 during the displacement process of the cam element 3, the catch bodies 22 are provided in the conical region of the hollow body with a pressure release opening 26.

The catch grooves 23, 24 extending adjacent in the axial direction on both sides of a peak 27 are constructed so that the peak 27 extends eccentrically—with respect to the spacing of the axial positions of the cam element 3 associated with the catch grooves 23, 24. As shall be shown in FIG. 2 by the respective (dashed-dotted) lines of symmetry of the catch grooves 23, 24 and the peak 27, this is displaced away from the spacing middle so that it extends on the side of the axial position in which the cam element 3 is pushed along the low connecting link pathway 9. In the case of the forced-guidance-free displacement of the cam element 3 along the high connecting link pathway 10, this construction has the result that the cam element 3 is already forced by an axial force directed in the associated (here, on the left side) axial position before passing through the intersection region 16. This results from the radial force of the spiral compression spring 25 deflected in the axial direction with which the catch bodies 22 apply force on the catch groove walls 28 and 29 going out from the peak 27. In other words, the catch device constructed in this way allows at least partial compensation of friction forces between the cam element 3 and carrier shaft 2 that endanger a complete displacement of the cam element 3 along the high connecting link pathway 10 in the case of a low rotational speed of the camshaft 1.

REFERENCE NUMBERS

1 Camshaft
2 Carrier shaft
3 Cam element
4 Bearing position
5 Cam
6 Cam
7 Cam roller
8 Axial connecting link
9 Low connecting link pathway
10 High connecting link pathway
11 Activation pin
12 Accelerating outer guide wall
13 Accelerating outer guide wall
14 Decelerating outer guide wall
15 Decelerating outer guide wall
16 Intersection region of the connecting link pathways
17 Outlet region
18 Inlet region
19 Inner guide wall
20 Inner guide wall
21 Radial borehole
22 Catch body
23 Catch groove
24 Catch groove
25 Spring element/spiral compression spring
26 Pressure releasing opening
27 Peak of the catch grooves
28 Catch groove wall
29 Catch groove wall
d End-face diameter of the activation pin
b Open width

The invention claimed is:

1. A valve-train assembly of an internal combustion engine, comprising a camshaft that has a carrier shaft as well as a cam element that is locked in rotation on the carrier shaft and that can move between two axial positions and that has at least one cam group of directly adjacent cams with different cam lobes, and an axial connecting link constructed with a groove with outer guide walls for defining two intersecting connecting link pathways, and with an activation pin that can couple in the axial connecting link for moving the cam element in a direction of both of the connecting link pathways, a groove base of one of the connecting link pathways and a groove base of the other of the connecting link pathways are offset in height radially relative to each other, so that the connecting link pathway with a radially lower groove base is also defined by inner guide walls that are formed by the offset in height.

2. The valve-train assembly according to claim 1, wherein the offset in height extends across at least approximately an entire peripheral region of the connecting link pathways.

3. The valve-train assembly according to claim 1, wherein, with respect to a rotational direction of the camshaft, the offset in height is larger immediately before an intersection region of the connecting link pathways than immediately after the intersection region.

4. The valve-train assembly according to claim 3, wherein the connecting link pathway with the radially lower groove base has, at least in the intersection region of the connecting link pathways, an undercut-like profile with an open width that is smaller than a diameter of the connecting link-side end face of the activation pin.

5. The valve-train assembly according to claim 4, wherein both of the connecting link pathways have an undercut profile.

6. The valve-train assembly according to claim 5, wherein the undercut profile has a dovetail or T-shaped construction.

7. The valve-train assembly according to claim 5, wherein a connecting link-side end section of the activation pin and the undercut profile have essentially complementary constructions relative to each other.

8. The valve-train assembly according to claim 1, further comprising a catch device for fixing the cam element in the axial positions, with at least one catch body supported so that it can move in a radial borehole of the carrier shaft and with catch grooves that extend axially adjacent on an inner periphery of the cam element on both sides of a peak and in which the catch body is locked in the axial positions, the catch body being forced by a spring element in a radially outward direction applies an axial force directed in the associated axial position onto catch groove walls of the catch grooves starting from the peak and wherein the peak extends, with respect to a distance of the axial positions, eccentrically on a side of the axial position in which the cam element is pushed along the connecting link pathway with the radially lower groove base.

9. The valve-train assembly according to claim 8, wherein two diametrically opposed catch bodies are provided in the radial borehole of the carrier shaft, which is constructed as a passage borehole.

10. The valve-train assembly according to claim 8, wherein the spring element comprises a spiral compression spring and the catch body comprises a sheet-metal formed part that is open on one side and an open side thereof is constructed as a hollow cylinder supported in the radial borehole and surrounding the spiral compression spring and a closed side thereof is constructed as at least one of a conical or spherical hollow body tapering in a direction of the catch grooves.

11. The valve-train assembly according to claim 10, wherein the catch body is provided in a region of the hollow body with a pressure release opening.

* * * * *